US010989161B2

(12) United States Patent
Ohno et al.

(10) Patent No.: US 10,989,161 B2
(45) Date of Patent: Apr. 27, 2021

(54) IGNITION DEVICE

(71) Applicant: DENSO CORPORATION, Kariya (JP)

(72) Inventors: Takashi Ohno, Kariya (JP); Keiko Miyake, Kariya (JP); Yasuo Kakumae, Kariya (JP); Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/804,332

(22) Filed: Feb. 28, 2020

(65) Prior Publication Data

US 2020/0200139 A1 Jun. 25, 2020

Related U.S. Application Data

(63) Continuation of application No. PCT/JP2018/031327, filed on Aug. 24, 2018.

(30) Foreign Application Priority Data

Aug. 31, 2017 (JP) ..... JP2017-167115

(51) Int. Cl.

| | |
|---|---|
| ***F02P 15/10*** | (2006.01) |
| ***F02P 3/04*** | (2006.01) |
| ***F02P 9/00*** | (2006.01) |

(52) U.S. Cl.
CPC ..... *F02P 15/10* (2013.01); *F02P 3/04* (2013.01); *F02P 9/00* (2013.01)

(58) Field of Classification Search
CPC ..... F02P 15/10; F02P 3/04; F02P 9/00
See application file for complete search history.

(56) References Cited

U.S. PATENT DOCUMENTS 9,371,814 B2 * 6/2016 Eisen ..... F02P 1/00

FOREIGN PATENT DOCUMENTS

JP 2016-053358 4/2016

* cited by examiner

*Primary Examiner* — Hieu T Vo
(74) *Attorney, Agent, or Firm* — Nixon & Vanderhye PC

(57) ABSTRACT

An ignition device includes: a primary coil including a first winding and a second winding connected in series to the first winding; a secondary coil connected to a spark plug and magnetically coupled to the primary coil; a first switch that opens or closes the electrical path between the first terminal and the ground; a second switch that opens or closes the electrical path between the power source and the second terminal; a third switch that opens or closes the electrical path between the power source and the connection point; a fourth switch that opens or closes the electrical path between the second terminal and the ground; and a switch control unit that controls the opening and closing of each switch to open or close each electrical path.

13 Claims, 9 Drawing Sheets

IGNITION DEVICE

CROSS-REFERENCE TO RELATED APPLICATION

This application is the U.S. bypass application of International Application No. PCT/JP2018/031327 filed Aug. 24, 2018, which designated the U.S. and claims priority to Japanese Patent Application No. 2017-167115 filed on Aug. 31, 2017, the contents of both of which are incorporated herein by reference.

BACKGROUND

Technical Field

The present disclosure relates to an ignition device for an internal combustion engine.

Related Art

To improve the fuel efficiency of automobile internal combustion engines, studies have been recently performed on technologies related to the combustion control of lean mixtures (lean-burn engines) or the exhaust gas recirculation (EGR), which recirculates combustion gas back into the cylinders of the internal combustion engine. To effectively combust the fuel contained in air-fuel mixture in these technologies, research has been carried out on continuous discharging methods of maintaining a spark discharge at a spark plug for a certain period of time just before and after the moment of ignition.

SUMMARY

As an aspect of the present disclosure, an ignition device for generating a spark discharge at a spark plug is provided. The ignition device includes: a primary coil including a first winding, a second winding connected in series to the first winding, a first terminal at an opposite end of the first winding from a connection point between the first winding and the second winding, and a second terminal at an opposite end of the second winding from the connection point; a secondary coil connected to the spark plug and magnetically coupled to the primary coil; a first switch connecting with the first terminal of the primary coil and configured to open or close an electrical path between the first terminal and ground; a second switch connecting with the second terminal of the primary coil and configured to open or close an electrical path between a power source and the second terminal; a third switch connecting with the connection point of the second winding and configured to open or close an electrical path between the power source and the connection point; a fourth switch connecting with the second terminal of the second winding and configured to open or close an electrical path between the second terminal and the ground; and a switch control unit configured to control opening and closing of the first switch, the second switch, the third switch, and the fourth switch to open or close each of the electrical paths.

DETAILED DESCRIPTION OF THE PREFERRED EMBODIMENTS

Figure 1:
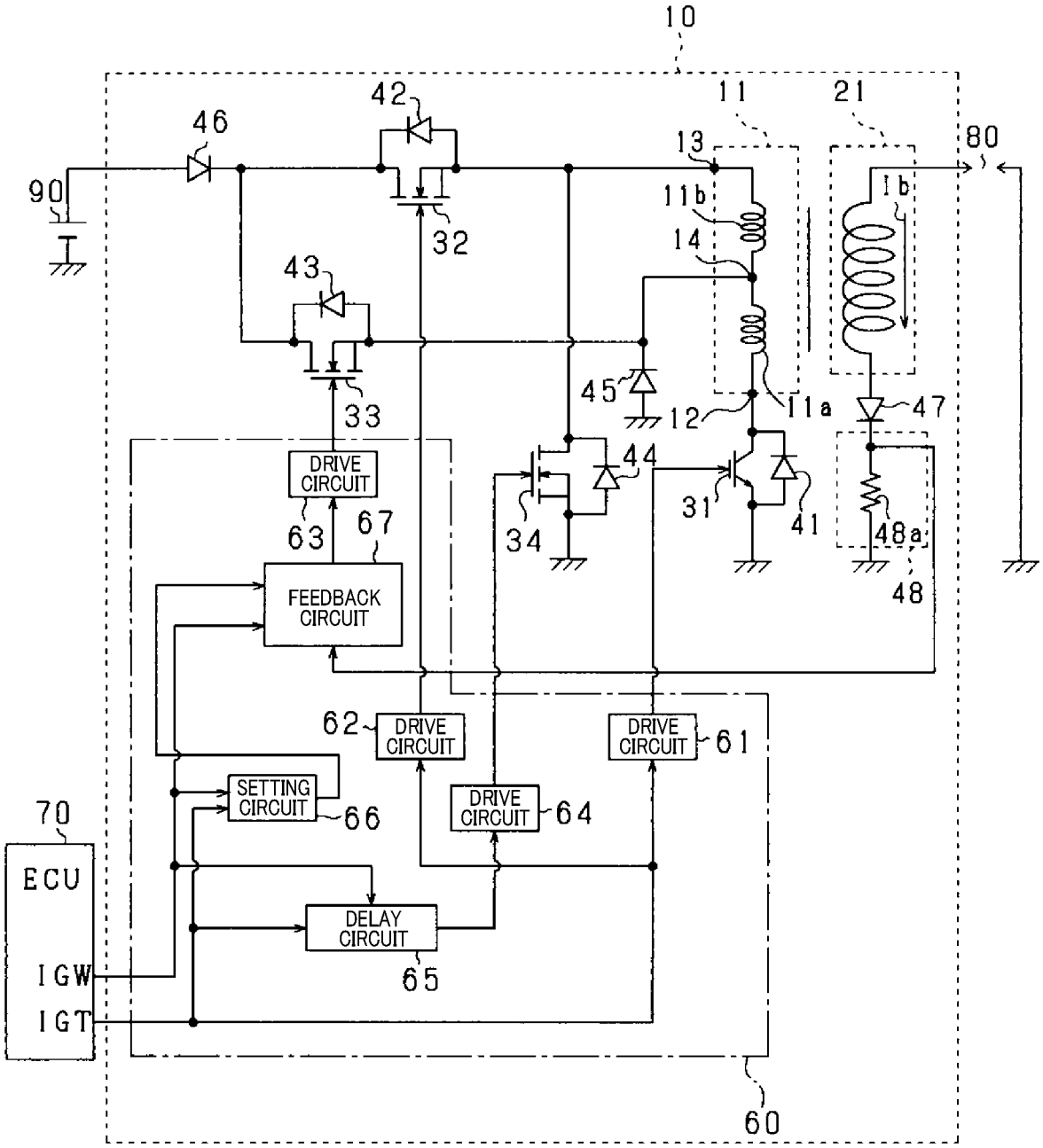
FIG. 1 is a circuit diagram illustrating the electrical structure of an ignition device.

To improve the fuel efficiency of automobile internal combustion engines, studies have been recently performed on technologies related to the combustion control of lean mixtures (lean-burn engines) or the exhaust gas recirculation (EGR), which recirculates combustion gas back into the cylinders of the internal combustion engine. To effectively combust the fuel contained in air-fuel mixture in these technologies, research has been carried out on continuous discharging methods of maintaining a spark discharge at a spark plug for a certain period of time just before and after the moment of ignition.

An example of ignition devices that use a continuous discharging method is disclosed in JP 2016-53358 A. The ignition device energizes a primary coil for a current to flow from a first terminal to a second terminal of the primary coil and then stops the energization, thereby starting the primary ignition at the spark plug. Then, the ignition device energizes the primary coil for a current to flow from the second terminal to the first terminal of the primary coil (in the opposite direction), thereby causing additional currents to flow successively in the same direction in which a current for starting the primary ignition (secondary current) flows in a secondary coil. This process maintains a spark discharge at the spark plug.

The ignition device described above generates, in the secondary coil, a secondary voltage sufficient to maintain a spark discharge at the spark plug, without using a booster circuit. Thus, the turns ratio of the secondary coil to the primary coil needs to be high. For example, the turns ratio of the secondary coil to the primary coil needs to be several hundreds.

However, a higher turns ratio between the secondary coil and the primary coil reduces the secondary current generated in the secondary coil for starting a spark discharge, thus deteriorating the ignitability. The present disclosers have noticed this disadvantage.

The present disclosure has been made to solve the above problem. A major object of the present disclosure is to provide an ignition device capable of maintaining a spark discharge in an appropriate manner without deterioration in the ignitability.

An embodiment of an ignition device for a multicylinder gasoline engine (internal combustion engine) incorporated in a vehicle will now be described with reference to the drawings. In the embodiments described below, the same or equivalent parts are given the same reference numerals throughout the drawings. The engine is, for example, a direct-injection gasoline engine allowing combustion with an excess of air (lean burn) and includes a swirl flow control unit for generating swirl flows (such as tumbles and whirls) of air-fuel mixture in the cylinders. The ignition device ignites (or sets fire to) the air-fuel mixture in the engine combustion chamber at a predetermined ignition time (ignition timing). The ignition device is a direct ignition (DI) device, in which each ignition coil is linked with the spark plug of its corresponding cylinder.

As illustrated in FIG. 1, an ignition device 10 controls the energization of a primary coil 11 included in an ignition coil in accordance with instruction signals (a primary ignition signal IGT and an energy addition signal IGW) provided by an electronic control unit (ECU) 70 that governs the engine control. The ignition device 10 controls the energization of the primary coil 11 to regulate the electrical energy generated in a secondary coil 21 included in the ignition coil, thus controlling a spark discharge occurring at a spark plug 80.

The ECU 70 selects an ignition mode in accordance with engine parameters (e.g., warm-up state, engine speed, engine load) obtained from various sensors and the control state of an engine 100 (e.g., whether the combustion is lean burn, and the degree of the swirl flows), and generates and outputs a primary ignition signal IGT and an energy addition signal IGW in accordance with the selected ignition mode.

In more detail, the ECU 70 is configured to select and start primary ignition (inductive discharge ignition) or energy addition ignition added to the primary ignition, depending on the engine speed and the engine load. The primary ignition consumes the smallest amount of energy and also uses the smallest amount of spark energy, and is appropriate to, for example, a stoichiometric operation. The energy addition ignition needs secondary currents Ib of the same polarity to continuously flow to the spark plug 80, and thus uses the largest amount of addition energy. However, the energy addition ignition is appropriate to the case in which fast air currents in the engine due to supercharging or EGR may distort or blow out the spark.

For primary ignition, the ECU 70 simply outputs a primary ignition signal IGT. In contrast, for energy addition ignition, the ECU 70 outputs a primary ignition signal IGT as well as an energy addition signal IGW.

The ignition device 10 includes the primary coil 11, the secondary coil 21, switching elements 31 to 34, diodes 41 to 47, a current sensing circuit 48, and a control circuit 60.

Figure 2:
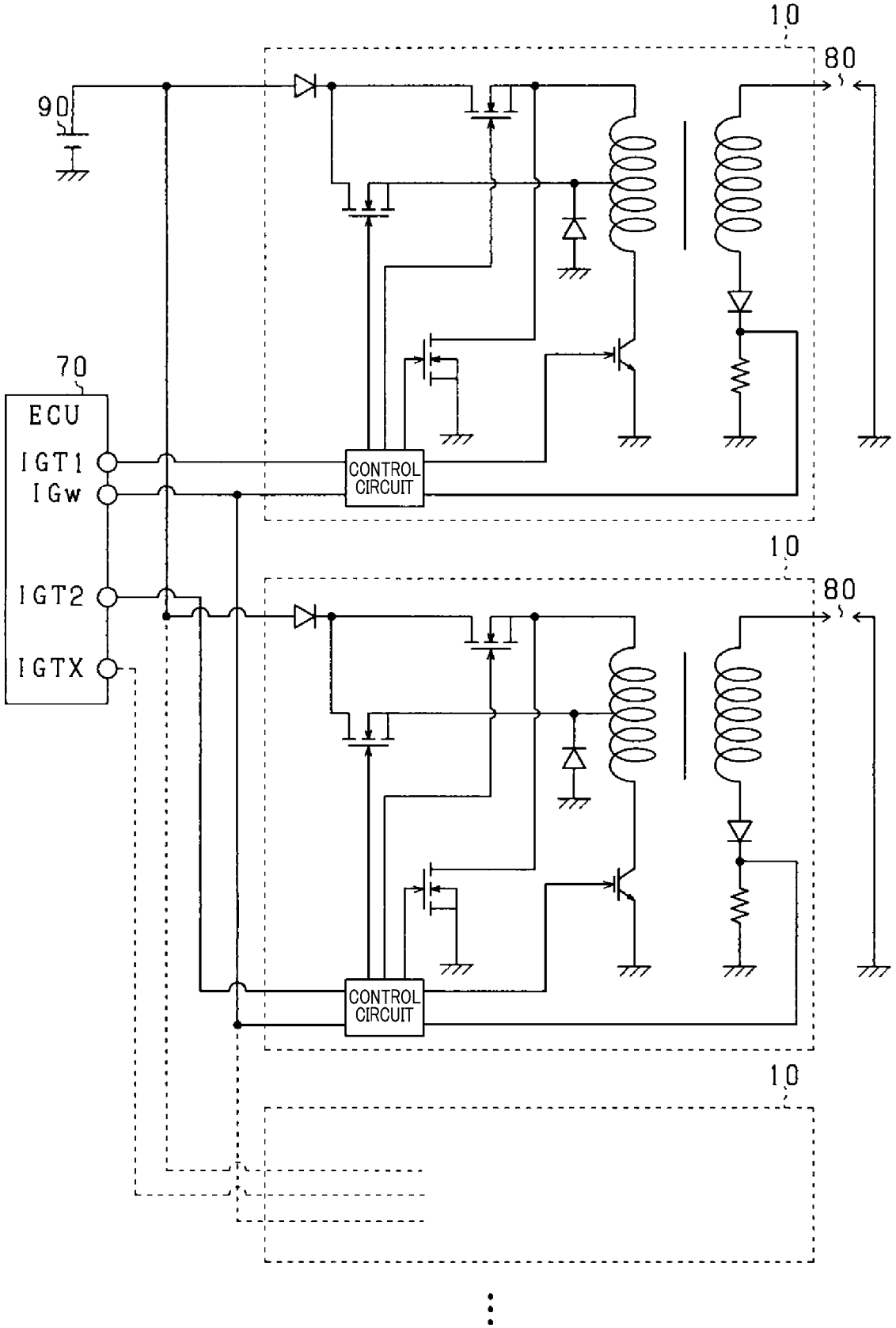
FIG. 2 is a diagram illustrating ignition devices for a multicylinder engine.

As illustrated in FIG. 2, a spark plug 80 and an ignition device 10 are installed for each cylinder of the engine 100. Although the ignition devices 10 are provided for the spark plugs 80 on a one-to-one basis, one spark plug 80 and its associated structure will now be described by way of example.

Figure 3:
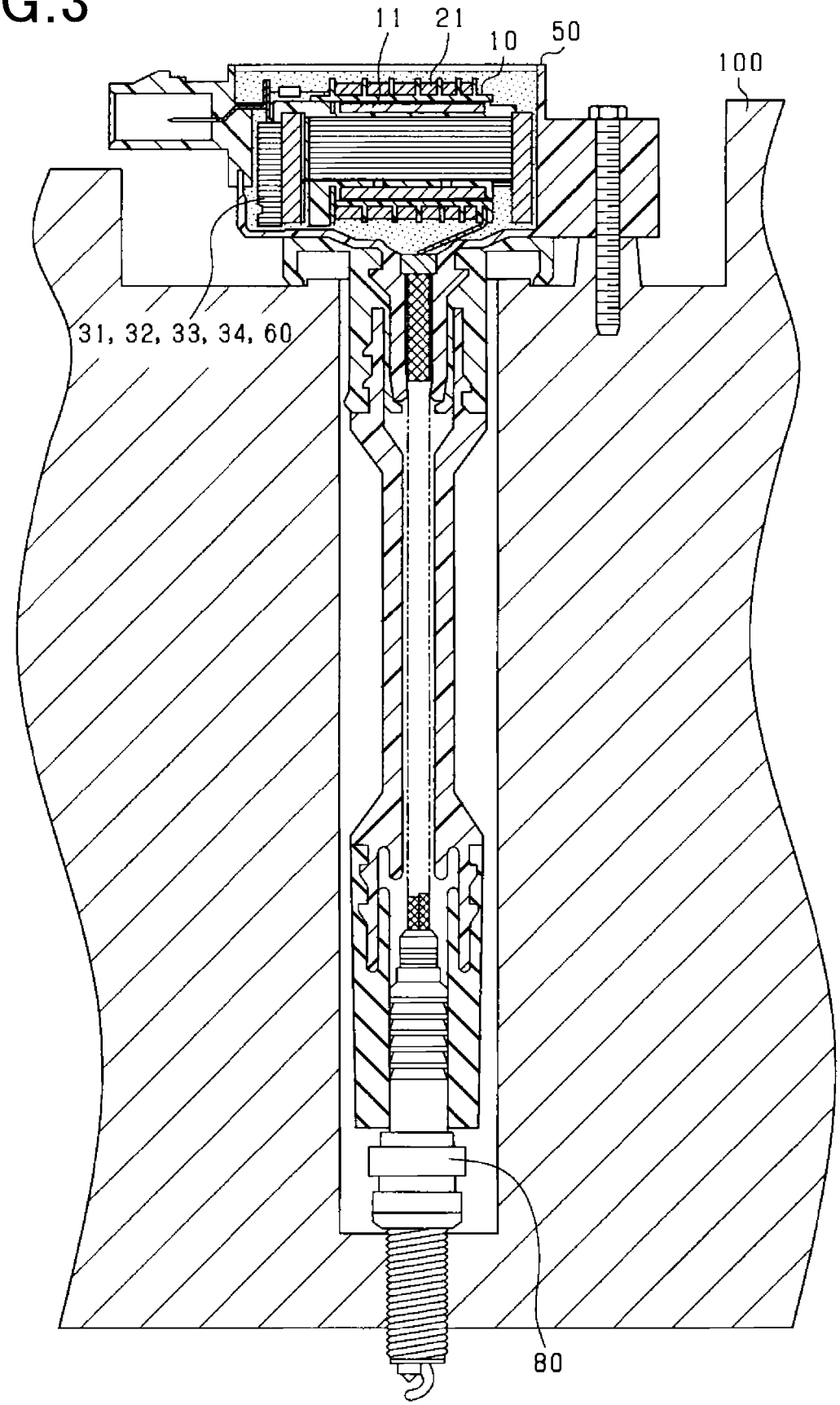
FIG. 3 is a cross-sectional view of a case for an ignition coil.

As illustrated in FIG. 3, the components of the ignition device 10 are contained in an ignition coil case 50, which is fastened to the engine 100. This structure allows reduction in wiring and prevents an increase in the volume of the ignition device 10, thus facilitating the installation in a vehicle.

The spark plug 80 has a well-known structure, and as illustrated in FIG. 1, includes a center electrode connected to one end of the secondary coil 21 via an output terminal, and an outer electrode connected to the ground (GND) (or grounded) via the cylinder head of the engine 100. The other end of the secondary coil 21 is connected to the GND (or grounded) through the diode 47 and a current sensing resistor 48*a*. The anode of the diode 47 is connected to the secondary coil 21, while the cathode thereof is connected to the current sensing resistor 48*a*.

The current sensing resistor 48*a* forms the current sensing circuit 48 serving as a secondary current sensing unit for sensing a secondary current Ib in the secondary coil 21. The current sensing circuit 48 outputs a signal representing the sensed secondary current Ib to the control circuit 60. The diode 47 prevents a spark discharge caused by an unnecessary voltage generated when the energization of the primary coil 11 starts. The spark plug 80 then causes a spark discharge between the center electrode and the outer electrode through electrical energy generated in the secondary coil 21.

The ignition coil includes the primary coil 11 and the secondary coil 21 magnetically coupled to the primary coil 11. The turns of the secondary coil 21 outnumber the turns of the primary coil 11.

The primary coil 11 includes a first terminal 12, a second terminal 13, and a center tap 14. In the primary coil 11, the winding between the first terminal 12 and the center tap 14 is a first winding 11*a*, while the winding between the center tap 14 and the second terminal 13 is a second winding 11*b*. In other words, the primary coil 11 has the first winding 11*a* and the second winding 11*b* connected in series with the first winding 11*a*. The center tap 14 serves as a connection point between the first winding 11*a* and the second winding 11*b*. The primary coil 11 has the first terminal 12 at the opposite end of the first winding 11*a* from the center tap 14, and the second terminal 13 at the opposite end of the second winding 11*b* from the center tap 14.

The first terminal 12 of the primary coil 11 is connected to the switching element 31. The switching element 31 is, for example, a semiconductor switching element such as a power transistor or an insulated gate bipolar transistor (IGBT). The switching element 31 has an output terminal connected to the GND (or grounded). That is, the switching element 31 is provided between the first terminal 12 and the GND and connected in series to the first winding 11*a*. The switching element 31 is configured to open or close the path between the first terminal 12 and the GND in accordance with a signal from the control circuit 60. Thus, the switching element 31 corresponds to a first switch that connects with the first terminal 12 of the primary coil 11 and opens or closes the electrical path between the first terminal 12 and the GND.

The switching element 31 is connected in parallel with the diode 41. The diode 41 may be a parasitic diode (body diode) of the switching element 31. The anode of the diode 41 is connected to the GND (or grounded), while the cathode is connected between the first terminal 12 and the switching element 31.

The second terminal 13 of the primary coil 11 is connected to the switching element 32. The switching element 32 is connected in series to the primary coil 11 (the first winding 11*a* and the second winding 11*b*) and the switching element 31. The switching element 32 is, for example, a semiconductor switching element such as a power transistor or a metal-oxide semiconductor (MOS) transistor. The switching element 32 is provided between the second terminal 13 and a battery 90 serving as a power source, and configured to open or close the path between the second terminal 13 and the battery 90 in accordance with a signal from the control circuit 60. The battery 90 is, for example, a well-known lead-acid battery and supplies a voltage of 12 V. The battery 90 is an on-vehicle power source. Thus, the switching element 32 corresponds to a second switch that connects with the second terminal 13 of the primary coil 11 and opens or closes the electrical path between the second terminal 13 and the battery 90.

The switching element 32 is connected in parallel with the diode 42. The diode 42 may be the parasitic diode of the MOS transistor. The anode of the diode 42 is connected between the second terminal 13 and the switching element 32, while the cathode of the diode 42 is connected between the switching element 32 and the battery 90.

The center tap 14 of the primary coil 11 is connected to the switching element 33. The switching element 33 is connected in series to the first winding 11*a* of the primary coil 11 and the switching element 31. The switching element 33 is, for example, a semiconductor switching element such as a power transistor or a MOS transistor. The switching element 33 is provided between the center tap 14 and the battery 90 and configured to open or close the path between the center tap 14 and the battery 90 in accordance with a signal from the control circuit 60. Thus, the switching element 33 corresponds to a third switch that connects with the center tap 14 of the second winding 11*b* and opens or closes the electrical path between the battery 90 and the center tap 14.

The switching element 33 is connected in parallel with the diode 43. The diode 43 may be a parasitic diode of the MOS transistor. The anode of the diode 43 is connected between the center tap 14 and the switching element 33, while the cathode of the diode 43 is connected between the switching element 33 and the battery 90.

The second terminal 13 of the primary coil 11 is also connected to the switching element 34. One end of the switching element 34 is connected between the second terminal 13 and the switching element 32 (and the anode of the diode 42), while the other end is connected to the GND. The switching element 34 is, for example, a semiconductor switching element such as a power transistor or a MOS transistor. The switching element 34 is provided between the second terminal 13 and the GND and configured to open or close the path between the second terminal 13 and the GND in accordance with a signal from the control circuit 60. Thus, the switching element 34 corresponds to a fourth switch that connects with the second terminal 13 of the second winding 11*b* and opens or closes the electrical path between the second terminal 13 and the GND.

The switching element 34 is connected in parallel with the diode 44. The diode 44 may be a parasitic diode of the MOS transistor. The anode of the diode 44 is connected between the GND and the switching element 34, while the cathode of the diode 44 is connected between the switching element 34 and the second terminal 13.

The center tap 14 is connected with a freewheeling diode 45. The anode of the freewheeling diode 45 is connected to the GND, while the cathode is connected between the switching element 33 (and the anode of the diode 43) and the center tap 14.

If the battery 90 is reverse connected, a large current may flow through the circuit via the diodes 41 to 44 connected in parallel with the switching elements 31 to 34. To eliminate the possibility, the ignition device 10 in the present embodiment has a backflow prevention diode 46 provided between the battery 90 and the switching element 32. The anode of the backflow prevention diode 46 is connected to the battery 90. The cathode of the backflow prevention diode 46 is connected to the switching element 32. More specifically, the battery 90, the backflow prevention diode 46, the switching element 32, the primary coil 11, and the switching element 31 are connected in series to each other. The cathode of the diode 42 is connected between the switching element 32 and the cathode of the backflow prevention diode 46.

The cathode of the backflow prevention diode 46 is also connected to the switching element 33. More specifically, the battery 90, the backflow prevention diode 46, the switching element 33, the second winding 11*b*, and the switching element 34 are connected in series to each other. The cathode of the diode 43 is connected between the switching element 33 and the cathode of the backflow prevention diode 46.

In this structure, the switching element 32 is connected to the cathode of the backflow prevention diode 46, so that a current from the battery 90 flows through the switching element 32 via the backflow prevention diode 46. The switching element 33 is also connected to the cathode of the backflow prevention diode 46, so that a current from the battery 90 flows through the switching element 33 via the backflow prevention diode 46.

The control circuit 60 (corresponding to a switch control unit) includes an input-output interface, driving circuits 61 to 64, a delay circuit 65, a setting circuit 66, and a feedback circuit 67. The control circuit 60 controls the switching elements 31 to 34 to be opened or closed (conducting or nonconducting, or turned on or off) in accordance with instruction signals from the ECU 70 and output from the current sensing circuit 48. In this manner, the control circuit 60 selects and performs one of the two ignition modes: the primary ignition (inductive discharge ignition) and the energy addition ignition. The control circuit 60 will now be described in detail.

The driving circuit 61 is configured to receive a primary ignition signal IGT from the ECU 70. While receiving the primary ignition signal IGT (in the high state), the driving circuit 61 outputs a signal to the switching element 31 (into the high state) for the switching element 31 to be closed (connected or turned on).

The driving circuit 62 is configured to receive a primary ignition signal IGT from the ECU 70. While receiving the primary ignition signal IGT (in the high state), the driving circuit 62 outputs a signal to the switching element 32 (into the high state) for the switching element 32 to be closed (connected or turned on).

The driving circuit 63 is configured to receive a signal from the feedback circuit 67. While receiving the signal from the feedback circuit 67 (in the high state), the driving circuit 63 outputs a signal to the switching element 33 (into the high state) for the switching element 33 to be closed (connected or turned on).

The driving circuit 64 is configured to receive a signal from the delay circuit 65. While receiving the signal from the delay circuit 65 (in the high state), the driving circuit 64 outputs a signal to the switching element 34 (into the high state) for the switching element 34 to be closed (connected or turned on).

The delay circuit 65 is configured to receive a primary ignition signal IGT and an energy addition signal IGW. When the primary ignition signal IGT transitions from the high state to the low state (or stops), the delay circuit 65 determines whether an energy addition signal IGW is being input (in the high state). If the delay circuit 65 determines that an energy addition signal IGW is being input, the delay circuit 65 waits for a predetermined delay time T1 to pass from the high-to-low transition of the primary ignition signal IGT. Then, the delay circuit 65 outputs a signal to the driving circuit 64 (into the high state).

The delay circuit 65 then stops outputting the signal to the driving circuit 64 (into the low state) in accordance with the energy addition signal IGW. More specifically, when the input of the energy addition signal IGW stops (or in response to a high-to-low transition), the delay circuit 65 stops outputting the signal to the driving circuit 64 (into the low state).

The maximum time T2 during which the delay circuit 65 outputs a signal to the driving circuit 64 may be set as appropriate. However, to reliably establish the energy addition path, the maximum time T2 is desirably longer than the maximum time from the falling edge of the primary ignition signal IGT to the falling edge of the energy addition signal IGW. Additionally, the output is desirably ended when the secondary current Ib reaches the lower limit.

The setting circuit 66 sets the upper limit and the lower limit of a target secondary current based on the time difference between the rising edges (low-to-high transitions) of the primary ignition signal IGT and the energy addition signal IGW. The upper limit and the lower limit of the target secondary current define the range of a secondary current Ib desired to flow through the secondary coil 21 during energy addition ignition.

More specifically, the setting circuit 66 measures the time from the low-to-high transition of the primary ignition signal IGT to the low-to-high transition of the energy addition signal IGW, and determines the upper and lower limits in accordance with the measured time. The upper limit and the lower limit depending on the measured time are prestored. Then (e.g., after the delay time T1 passes from the high-to-low transition of the primary ignition signal IGT), the setting circuit 66 outputs the determined upper and lower limits to the feedback circuit 67 to set the upper limit and the lower limit in the feedback circuit 67.

When the ECU 70 selects the energy addition ignition and outputs a primary ignition signal IGT and an energy addition signal IGW, the ECU 70 changes the time difference between the rising edges of the primary ignition signal IGT and the energy addition signal IGW in accordance with the operating conditions of the engine 100, allowing the lower and upper limits to be changed in accordance with the operating conditions of the engine 100. Additionally, the delay time T1 is set to be longer than a time period during which primary ignition starts, a spark occurs between the electrodes of the spark plug 80, and a secondary current is generated. The longer delay time T1 prevents a current application to the second winding 11*b* through the energy addition operation from affecting the primary ignition operation.

After the setting of the target secondary current, while receiving the energy addition signal IGW, the feedback circuit 67 outputs a signal to the driving circuit 63 based on a comparison between the target secondary current and a secondary current Ib sensed by the current sensing circuit 48. More specifically, the feedback circuit 67 switches between outputting a signal to the driving circuit 63 (the high state) and stopping the output (the low state) so that the absolute value of the secondary current Ib sensed by the current sensing circuit 48 is maintained between the lower and upper limits of the target secondary current while the feedback circuit 67 is receiving the energy addition signal IGW (in the high state).

Figure 4:
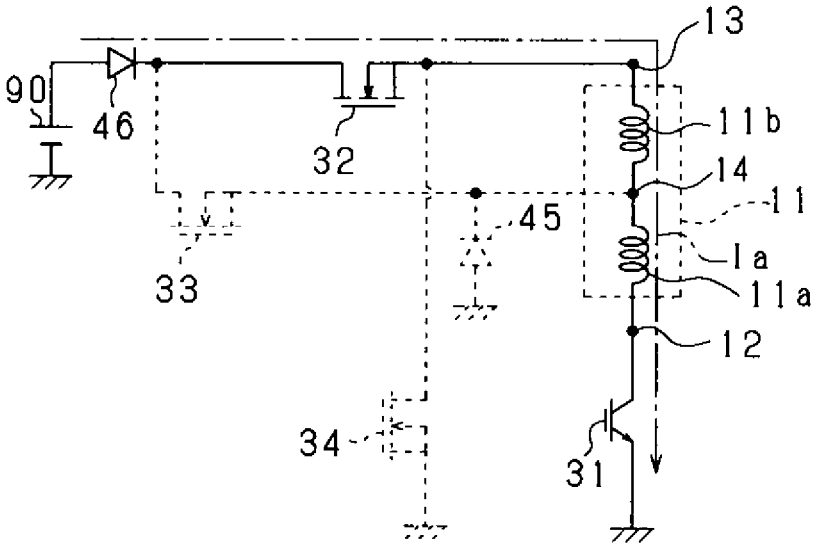
FIG. 4 is a circuit diagram in which primary ignition is caused.

The details of primary ignition will now be described with reference to FIG. 4. In FIG. 4, current-carrying paths are shown by solid lines, while non-current-carrying paths are by dashed lines. As illustrated in this drawing, the switching elements 31 and 32 are closed with the switching elements 33 and 34 open. In this state, a current flows along a path from the battery 90, through the backflow prevention diode 46, the switching element 32, the primary coil 11, the switching element 31, to the GND. That is, a primary current Ia flows from the second terminal 13 of the primary coil 11 to the first terminal 12.

Although a secondary current Ib will flow through the secondary coil 21 in response to the start of the energization of the primary coil 11, the diode 47 prevents the flow. During primary ignition, no current flows without passing through the second winding 11*b* because the switching element 33 is open. In addition, no current flows to the GND because the switching element 34 is open. Thus, the primary current Ia flowing through the primary coil 11 is prevented from decreasing.

Then, the switching element 31 is opened to disconnect the first terminal 12 from the GND. As a result, a high voltage is generated across the secondary coil 21 to trigger primary ignition at the spark plug 80 and start a spark discharge. In this state, a secondary current Ib flows through the secondary coil 21.

Figure 5:
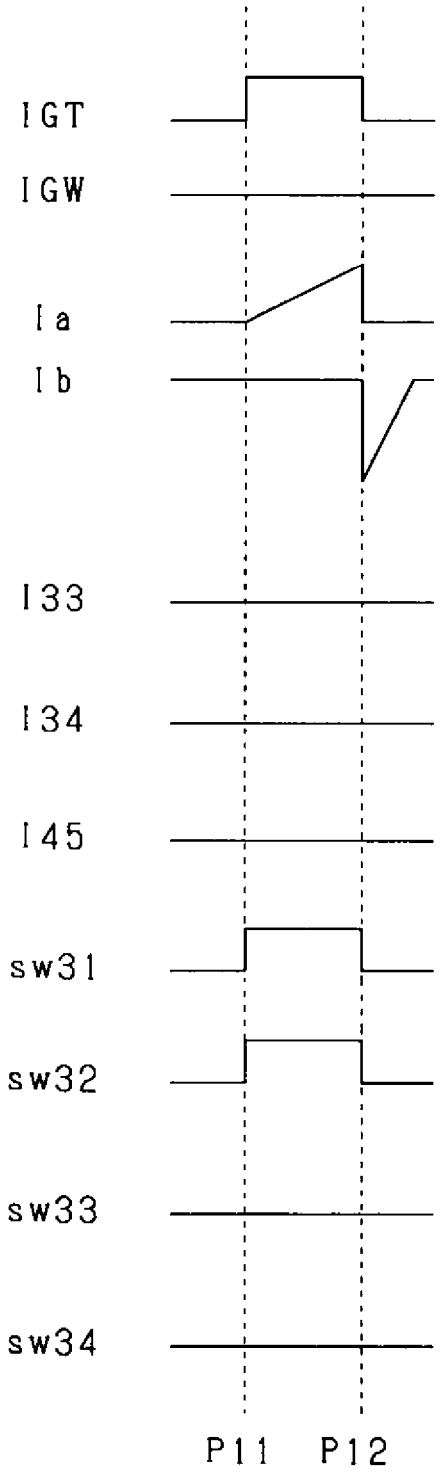
FIG. 5 is a timing chart in which primary ignition is caused.

The timing to receive various signals and changes in currents during primary ignition will now be described with reference to FIG. 5. In FIG. 5, the primary ignition signal IGT is denoted by IGT, while the energy addition signal IGW is denoted by IGW. In FIG. 5, the current flowing through the primary coil 11 (primary current) is denoted by Ia, while the current flowing through the secondary coil 21 (secondary current) is denoted by Ib. In FIG. 5, the current flowing through the switching element 33 is denoted by I33, the current flowing through the switching element 34 is denoted by I34, and the current flowing through the free-wheeling diode 45 is denoted by I45.

In FIG. 5, the signal from the control circuit 60 (more specifically, the driving circuit 61) to the switching element 31 is denoted by sw31. In FIG. 5, the signal from the control circuit 60 (more specifically, the driving circuit 62) to the switching element 32 is denoted by sw32. In FIG. 5, the signal from the control circuit 60 (more specifically, the driving circuit 63) to the switching element 33 is denoted by sw33. In FIG. 5, the signal from the control circuit 60 (more specifically, the driving circuit 64) to the switching element 34 is denoted by sw34.

As illustrated in FIG. 5, the driving circuits 61 and 62 of the control circuit 60 respectively control the switching elements 31 and 32 to be closed (turned on or conducting; the same shall apply hereinafter) over a period of time during which the primary ignition signal IGT from the ECU 70 is high (time points P11 to P12). That is, the driving circuits 61 and 62 respectively output signals to the switching elements 31 and 32 (into the high state) from the time point P11 to the time point P12.

As a result, a voltage from the battery 90 (battery voltage) is applied to the primary coil 11, and the primary current Ia flows from the second terminal 13 to the first terminal 12.

Then, the primary current Ia increases, and the primary ignition signal IGT becomes low at the time point P12, at which the driving circuits 61 and 62 respectively control the switching elements 31 and 32 to be opened (turned off or nonconducting; the same shall apply hereinafter). That is, the driving circuits 61 and 62 respectively stop outputting signals to the switching elements 31 and 32 (into the low state) at the time point P12.

As a result, a high voltage is generated in the primary coil 11 and the secondary coil 21, causing a spark discharge to occur at the spark plug 80 and the secondary current Ib to flow through the secondary coil 21. Then, the secondary current Ib decays. When the secondary current Ib decays and falls below a discharge maintaining current, which is the minimum current enough to maintain a discharge, the discharge at the spark plug 80 ends.

Figure 6:
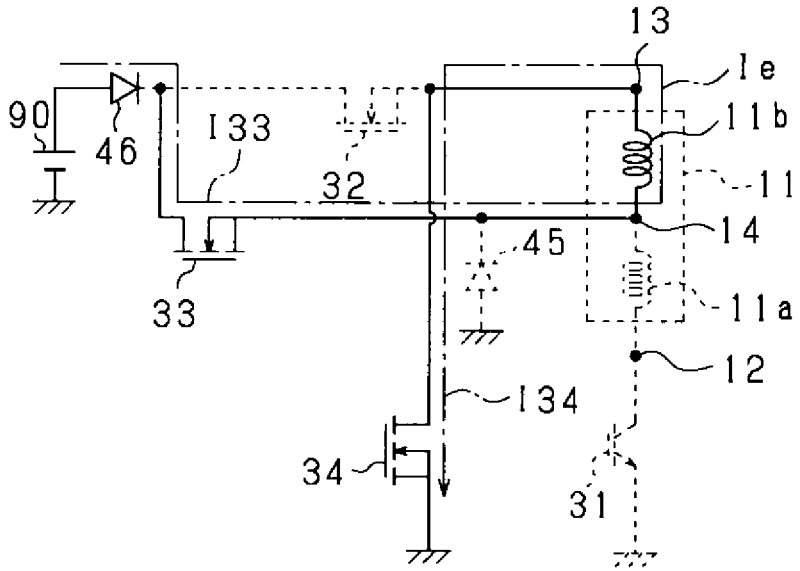
FIGS. 6(*a*) and 6(*b*) are circuit diagrams in which energy addition ignition is caused.
Figure 6:
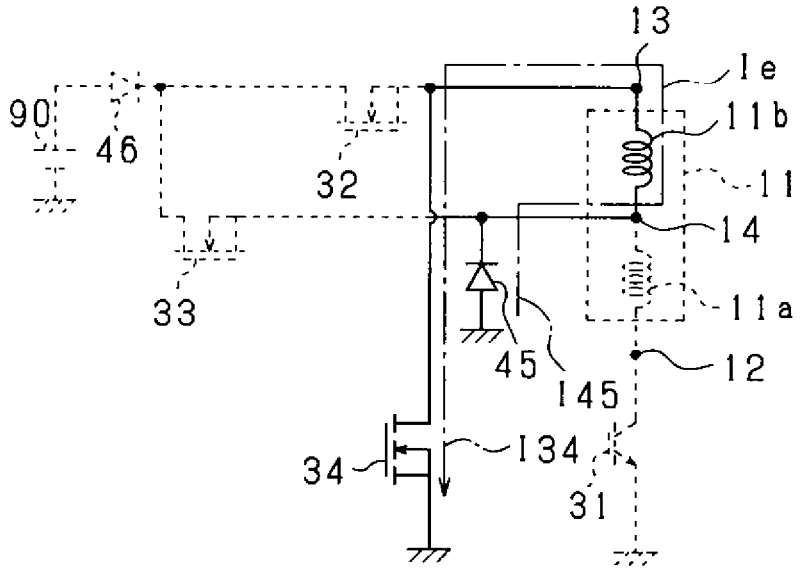

The details of energy addition ignition will now be described with reference to FIG. 6. In FIG. 6, current-carrying paths are indicated by solid lines, and non-current-carrying paths are indicated by dashed lines. As illustrated in FIG. 6(*a*), after the primary ignition starts, the switching elements 31 and 32 are opened, while the switching elements 33 and 34 are closed. In this state, a current flows along a path from the battery 90, through the backflow prevention diode 46, the switching element 33, the second winding 11*b*, the switching element 34, to the GND. That is, a primary current Ie flows from the center tap 14 of the primary coil 11 to the second terminal 13 (energy addition). As a result, a high voltage is generated across the secondary coil 21 in the same direction as the induced discharge, and a current is added to the secondary current Ib.

The turns ratio between the secondary coil 21 and the second winding 11*b* is set so that the voltage generated across the secondary coil 21 during energy addition is higher than the discharge maintaining voltage sufficient to maintain the spark discharge. More specifically, the turns ratio determined by dividing the number of turns of the secondary coil 21 by the number of turns of the second winding 11*b* is greater than the voltage ratio determined by dividing the discharge maintaining voltage sufficient to maintain the spark discharge by the voltage applied by the battery 90.

In energy addition ignition, the ignition device 10 generates, in the secondary coil 21, a secondary voltage sufficient to maintain a spark discharge, without using a booster circuit. Thus, the turns ratio of the secondary coil 21 to the second winding 11*b* is set at a high value. For example, the turns ratio of the secondary coil 21 to the second winding 11*b* is set at several hundreds.

However, the control circuit 60 passes an electric current through the primary coil 11 (the first winding 11*a* and the second winding 11*b*) to start a spark discharge, and passes an electric current through the second winding 11*b* to maintain a spark discharge. Thus, even for a high turns ratio of the secondary coil 21 to the second winding 11*b*, the number of turns of the first winding 11*a* can be adjusted to prevent an increase in the turns ratio of the secondary coil 21 to the primary coil 11. That is, the turns ratio of the secondary coil 21 to the primary coil 11 can be set by adjusting the number of turns of the second winding 11*b*.

In this coil structure, a high secondary current Ib can flow through the secondary coil 21 at the start of a spark discharge, and for maintaining the spark discharge, low-voltage energy addition is allowed while a high secondary voltage can be generated in the secondary coil 21. In other words, the spark discharge can be maintained in an appropriate manner without deterioration in the ignitability.

Since the number of turns of the primary coil 11 is the sum of those of the first winding 11*a* and the second winding 11*b*, the secondary coil 21 can have an appropriate voltage and an appropriate secondary current Ib at the start of a spark discharge.

Refer back to FIG. 6. In response to energy addition, the secondary current Ib gradually increases. Then, to regulate the secondary current Ib within a predetermined range, the switching element 33 is opened to stop the energy addition, thus checking the increase in the secondary current Ib.

When the switching element 33 is opened, the resultant disconnection from the battery 90 stops the secondary current Ib. However, the current flowing in the second winding 11*b* suddenly falls, resulting in a sudden decrease in the secondary current Ib. If the secondary current Ib suddenly decreases to the discharge maintaining current or lower, the spark discharge may stop. If the spark discharge stops, even a restart of energy addition cannot bring about a spark discharge due to a low voltage generated across the second winding 11*b*, failing to increase the secondary current Ib.

To eliminate the possibility, the ignition device 10 in the present embodiment includes a freewheeling mechanism. More specifically, the freewheeling diode 45 is provided as a freewheeling mechanism. As illustrated in FIG. 6(*b*), when the switching element 33 is opened, a freewheeling current flows along a freewheeling path from the GND, through the freewheeling diode 45, the second winding 11*b*, the switching element 34, to the GND. The flow of the freewheeling current prevents a sudden decrease in the primary current Ie and also in the secondary current Ib. This enables the secondary current Ib to be easily controlled within the predetermined range.

When the secondary current Ib decreases to a predetermined value, the switching element 33 is controlled to be closed again.

After that, the switching element 33 is opened and closed to control the secondary current Ib within the predetermined range. The control allows an energy addition ignition at the spark plug 80, maintaining the spark discharge.

Figure 7:
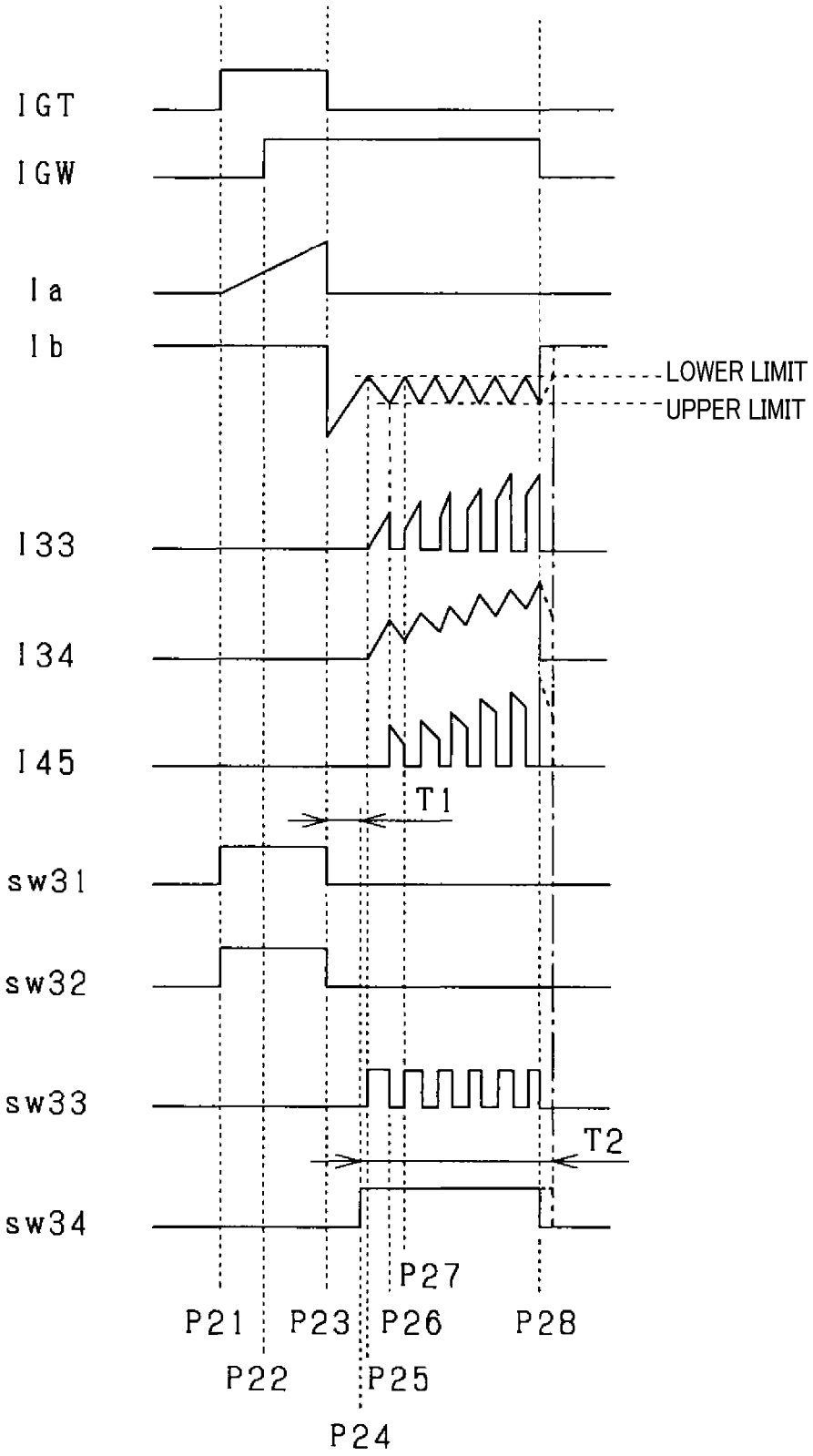
FIG. 7 is a timing chart in which energy addition ignition is caused.

The timing to receive various signals and changes in currents during energy addition ignition after primary ignition will now be described with reference to FIG. 7. In FIG. 7, the symbols IGT, IGW, Ia, Ib, I33, I34, I45, sw31, sw32, sw33, and sw34 have the same meaning as those in FIG. 5. As illustrated in FIG. 7, energy addition ignition is triggered by the control circuit 60 when the primary ignition signal IGT transitions from the high state to the low state with the energy addition signal IGW high.

When the primary ignition signal IGT becomes high at a time point P21, the driving circuits 61 and 62 respectively control the switching elements 31 and 32 to be closed. That is, the driving circuits 61 and 62 respectively output signals to the switching elements 31 and 32 (into the high state). As a result, a voltage from the battery 90 (battery voltage) is applied to the primary coil 11, and the primary current Ia flows from the second terminal 13 to the first terminal 12. Then, the primary current Ia gradually increases until the switching elements 31 and 32 are opened (from the time point P21 to a time point P23).

When the primary ignition signal IGT becomes low at the time point P23, the driving circuits 61 and 62 respectively control the switching elements 31 and 32 to be opened. That is, the driving circuits 61 and 62 respectively stop outputting signals to the switching elements 31 and 32 (into the low state). As a result, a high voltage is generated in the primary coil 11 and the secondary coil 21, causing a spark discharge to occur at the spark plug 80 and the secondary current Ib to flow through the secondary coil 21. Then, the secondary current Ib in the secondary coil 21 gradually decreases until energy addition (from the time point P23 to a time point P24).

At the time point P24, the driving circuit 64 receives a signal from the delay circuit 65 and controls the switching element 34 to be closed. That is, at the time point P24, the driving circuit 64 outputs a signal to the switching element 34 (into the high state). The time point P24 is a time point at which the predetermined delay time T1 has passed from the time point P23, or the high-to-low transition of the primary ignition signal IGT. Accordingly, the switching element 34 is closed after the delay time T1 has passed from the time point P23, at which the primary ignition signal IGT has transitioned from the high state to the low state.

Also at the time point P24, the setting circuit 66 sets the upper limit and the lower limit of the target secondary current for the feedback circuit 67. The upper limit and the lower limit of the target secondary current are determined in accordance with the time period from the time point P21, or the low-to-high transition of the primary ignition signal IGT, to the time point P22, or the low-to-high transition of the energy addition signal IGW.

After the setting of the target secondary current, while the energy addition signal IGW is high (the time point P24 to a time point P28), the driving circuit 63 controls the opening and closing of the switching element 33 based on a signal from the feedback circuit 67 and the secondary current Ib. More specifically, the driving circuit 63 switches between outputting a signal to the switching element 33 and stopping the output based on a signal from the feedback circuit 67 in a manner to maintain the secondary current Ib between the lower and upper limits of the target secondary current.

In one example, when the absolute value of the secondary current Ib decreases to or falls below the lower limit of the target secondary current, as indicated at the time points P25 to P26, the control circuit 60 outputs signals to the switching elements 33 and 34 (into the high state) to close the switching elements 33 and 34.

In this state, a primary current Ie flows from the center tap 14 of the primary coil 11 to the second terminal 13 (energy addition). That is, a current I33 (approximately equal to the primary current Ie) flows through the switching element 33, and a current I34 (approximately equal to the primary current Ie) flows through the switching element 34. As a result, a high voltage is generated across the secondary coil 21 in the same direction as the induced discharge, and a current is added to the secondary current Ib for the secondary current Ib to increase. With energy addition, the primary current Ie increases. During this period, no current flows through the freewheeling diode 45.

In another example, when the absolute value of the secondary current Ib reaches or exceeds the upper limit of the target secondary current, as indicated at the time points P26 to P27, the control circuit 60 stops outputting the signal to the switching element 33 (into the low state) for the switching element 33 to be opened with the switching element 34 closed. As a result, the battery 90 stops the power supply (energy addition) to the second winding 11*b*.

In this state, a freewheeling current flows along a freewheeling path from the GND, through the freewheeling diode 45, the second winding 11*b*, the switching element 34, to the GND. That is, as illustrated in FIG. 7, the current I34 flows through the switching element 34, while the current I45 (approximately equal to I34) also flows through the freewheeling diode 45. In contrast, the current I33 does not flow through the switching element 33.

In this manner, the freewheeling current flowing through the second winding 11*b* prevents a sudden decrease in the primary current Ie and allows the secondary current Ib to decrease slowly rather than suddenly falling. This enables the secondary current Ib to be easily controlled within the predetermined range.

Thus, while the energy addition signal IGW is high (the time point P24 to the time point P28), the control circuit 60 controls the switching elements 33 and 34 in a manner to maintain the secondary current Ib between the lower and upper limits of the target secondary current.

Then, when the energy addition signal IGW transitions from the high state to the low state (at the time point P28), the control circuit 60 stops outputting the signals to the switching elements 33 and 34 (into the low state) for the switching elements 33 and 34 to be opened. As a result, the secondary current Ib falls below the discharge maintaining current, which is the minimum current enough to maintain a discharge, and then the discharge at the spark plug 80 ends.

The time period from the time point P23, or the high-to-low transition of the primary ignition signal IGT, to the time point P28, or the high-to-low transition of the energy addition signal IGW, is set by the ECU 70 in accordance with the operating conditions of the engine 100.

The embodiment described in detail above has advantageous effects described below.

As one advantageous effect, the control circuit 60 closes the switching elements 31 and 32 for a current to flow from the second terminal 13 of the primary coil 11 to the first terminal 12, and then opens the switching elements 31 and 32 to stop the energization of the primary coil 11. This allows the generation of a secondary voltage in the secondary coil 21 and a spark discharge at the spark plug 80. After the generation of the spark discharge, the control circuit 60 can close the switching elements 33 and 34 to energize the second winding 11*b*. During the energization, a current flows from the center tap 14 to the second terminal 13. In this manner, the control circuit 60 allows an additional current to flow in the same direction as the secondary current Ib flowing through the secondary coil 21, maintaining the spark discharge.

To start a spark discharge, the control circuit 60 causes a current to flow through the primary coil 11 (the first winding 11*a* and the second winding 11*b*). To maintain the spark discharge, the control circuit 60 causes a current to flow through the second winding 11*b*. Thus, even for a high turns ratio of the secondary coil 21 to the second winding 11*b*, the number of turns of the first winding 11*a* can be adjusted to prevent an increase in the turns ratio of the secondary coil 21 to the primary coil 11. That is, the turns ratio of the secondary coil 21 to the primary coil 11 can be set without being bound by the number of turns of the second winding 11*b*.

This coil structure allows a high secondary current Ib to flow through the secondary coil 21 at the start of a spark discharge, and a high secondary voltage to be generated in the secondary coil 21 for maintaining the spark discharge. In other words, the spark discharge can be maintained in an appropriate manner without deterioration in the ignitability.

In addition, with the turns ratio of the secondary coil 21 to the primary coil 11 set without being bound by the number of turns of the second winding 11*b*, a spark discharge (primary ignition) can be started with a reduced secondary voltage generated in the secondary coil 21. Correspondingly, the voltage applied to the diode 47 can be reduced. Thus, the diode 47 can have a lower breakdown voltage or may be removed, which leads to a reduction in the cost of the ignition device 10.

As another advantageous effect, when starting a spark discharge, the control circuit 60 opens both the switching elements 33 and 34 to minimize the loss that is due to the switching elements 33 and 34. The control circuit 60 can thus maximize the variation caused by stopping the primary current Ia, thereby improving the performance of the primary ignition.

As still another advantageous effect, after the generation of the spark discharge, the control circuit 60 closes the switching elements 33 and 34 to energize the second winding 11*b*. At the same time, a primary current Ie flows from the center tap 14 to the second terminal 13. In this manner, the control circuit 60 allows an additional current to flow in the same direction as the secondary current Ib flowing through the secondary coil 21, thereby maintaining the spark discharge. When maintaining the spark discharge, the control circuit 60 opens both the switching elements 31 and 32 to prevent a reduction in the primary current Ie for energy addition to the second winding 11*b*.

As still another advantageous effect, when the control circuit 60 stops the energy addition while maintaining the spark discharge, the freewheeling mechanism keeps a current flowing through the second winding 11*b*. More specifically, a freewheeling mechanism is provided by a simple structure including the freewheeling diode 45 with its anode connected to the GND and its cathode connected between the center tap 14 and the switching element 33. Thus, when the control circuit 60 stops the energy addition while maintaining the spark discharge, the control circuit 60 opens the switching element 33 with the switching element 34 closed to allow a current to keep flowing through the second winding 11*b* via the freewheeling diode 45. Accordingly, while maintaining the spark discharge, the control circuit 60 can prevent a sudden decrease in the current flowing in the second winding 11*b*, allowing a gradual decrease in the secondary current Ib flowing in the secondary coil 21. In addition, since the control circuit 60 controls the primary current Ie flowing in the second winding 11*b* in a manner to keep the secondary current Ib within a predetermined range, the control circuit 60 can easily open or close the switching element 33 at the right time.

As still another advantageous effect, when maintaining a spark discharge, the control circuit 60 opens or closes the switching element 33 in accordance with the secondary current Ib sensed by the current sensing circuit 48. The control circuit 60 can thus keep the secondary current Ib within appropriate values to maintain the spark discharge in an appropriate manner.

As still another advantageous effect, the switching element 32 may have an antiparallel diode 42, and the switching element 33 may have an antiparallel diode 43. Thus, if the battery 90 is reverse connected, a large current may flow through the circuit via the diodes 42 and 43. To eliminate the possibility, the backflow prevention diode 46 is provided between the battery 90 and the switching elements 32 and 33. Even if the battery 90 is reverse connected, the backflow prevention diode 46 can protect the circuit. In particular, as in the ignition device 10, even if the second winding 11*b* has low impedance, a large current can be prevented from flowing through the circuit.

The backflow prevention diode 46 can also prevent a current from flowing along a path from the GND, through the switching element 34, the second winding 11*b*, the switching element 33, to the battery 90 at the start of a spark discharge. This prevents a decrease in the primary current Ia generated in the primary coil 11 at the start of a spark discharge.

As still another advantageous effect, the turns ratio determined by dividing the number of turns of the secondary coil 21 by the number of turns of the second winding 11*b* is greater than the voltage ratio determined by dividing the discharge maintaining voltage sufficient to maintain the spark discharge by the voltage applied by the battery 90. When the spark discharge is maintained, this coil structure allows direct energy addition from a power source such as an on-vehicle battery without a booster circuit.

As still another advantageous effect, the battery 90 for applying a voltage to the primary coil 11 to start a spark discharge is an on-vehicle power source and also serves as a power source for applying a voltage to the second winding 11*b* to maintain the spark discharge. Thus, the ignition device 10 may not include a power source, and accordingly the ignition device 10 may be reduced in size. The use of the on-vehicle power source eliminates the need for an extra power source, allowing a reduction in size. Also, the use of the battery 90 for two or more purposes eliminates the need for different power sources, thus allowing a reduction in size.

As still another advantageous effect, the primary coil 11, the secondary coil 21, the switching elements 31 to 34, and the control circuit 60 are contained in the case 50 for the ignition coil. This structure facilitates the installation in a vehicle and allows a reduction in wiring.

As still another advantageous effect, the control circuit 60 sets the upper limit and the lower limit of a target secondary current based on the time difference between the rising edges of the primary ignition signal IGT and the energy addition signal IGW. The control circuit 60 then controls the opening and closing of the switching element 33 in a manner to keep the secondary current Ib within the range. In addition, the control circuit 60 can control energy addition to be turned on or off in accordance with whether an energy addition signal IGW is received. The ECU 70 can thus control the secondary current Ib and the energy addition time appropriately in accordance with the environment and the operating conditions of the engine 100. The control can achieve an improvement in the ignitability, a power saving, and minimization of wear on the spark plug 80.

Other Embodiments

The present disclosure may be implemented not as in the above embodiment but as in the examples described below. In the embodiments described below, the same or equivalent parts are given the same reference numerals, and will not be described repeatedly.

In the embodiment described above, the freewheeling mechanism may be modified as appropriate.

Figure 8:
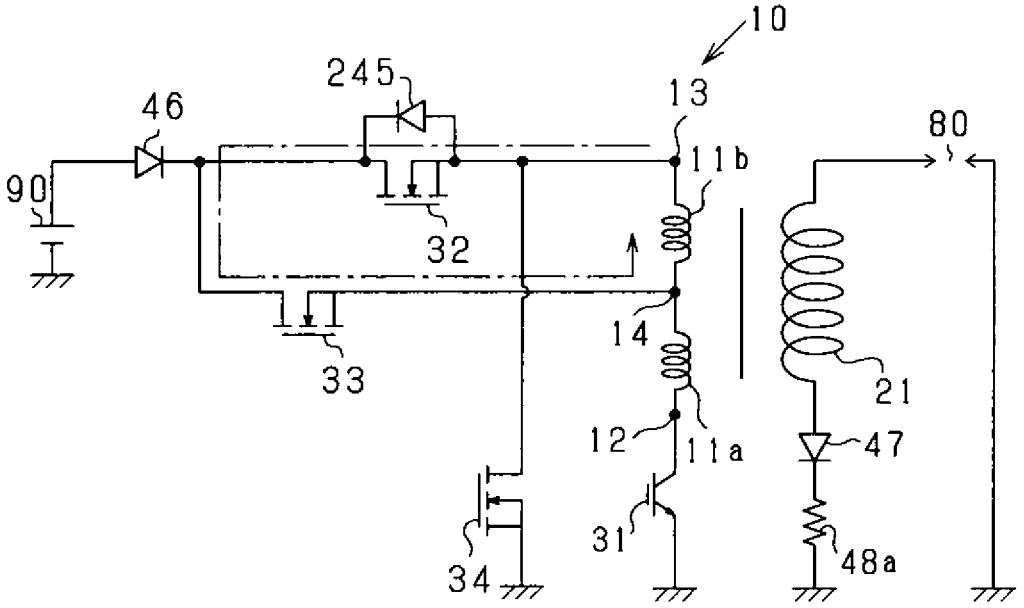
FIG. 8 is a circuit diagram illustrating the electrical structure of an ignition device according to a modification.

In one example, as illustrated in FIG. 8, the freewheeling mechanism may include a freewheeling diode 245 provided in parallel with the switching element 32. The freewheeling diode 245 has an anode connected between the second terminal 13 and the switching element 32, and a cathode connected between the battery 90 and the switching element 32.

In this structure, when the control circuit 60 stops the energy addition (power supply) while maintaining the spark discharge, the control circuit 60 opens the switching element 34 with the switching element 33 closed to allow a current to keep flowing through the second winding 11*b* via the freewheeling diode 245 and the switching element 33. If the switching element 32 has its parasitic diode (the diode 42), the parasitic diode may be used as the freewheeling diode 245. In this way, such a simple structure provides a freewheeling mechanism.

Figure 9:
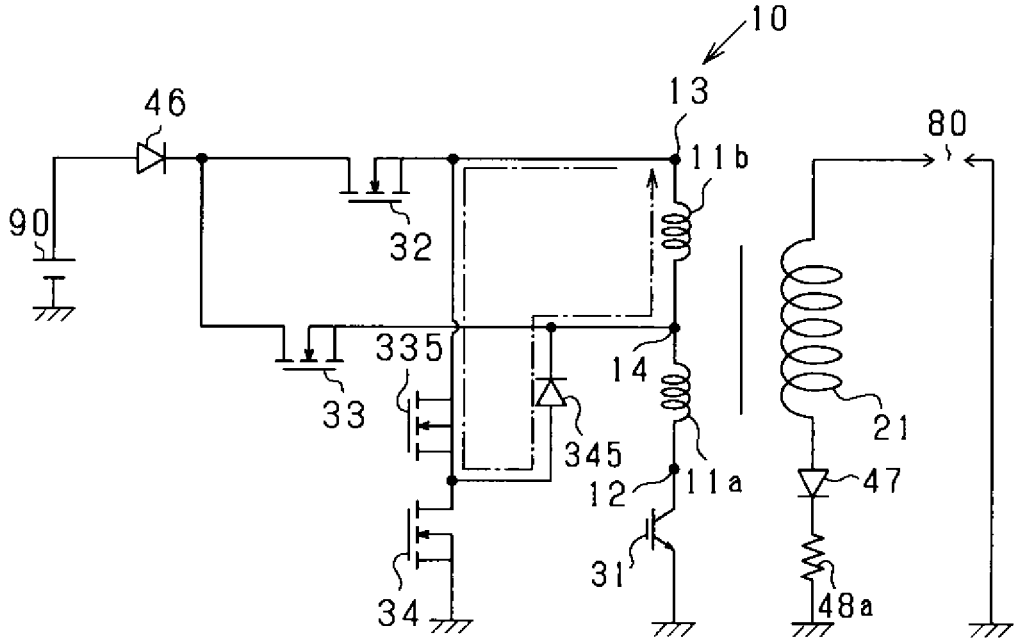
FIG. 9 is a circuit diagram illustrating the electrical structure of an ignition device according to another modification.

In another example, as illustrated in FIG. 9, the freewheeling mechanism may include a switching element 335 serving as a fifth switch between the second terminal 13 and the switching element 34, and a freewheeling diode 345 provided on the path between the switching element 335 and the center tap 14. More specifically, the switching element 335 is connected in series to the switching element 34 with one end connected between the switching element 32 and the second terminal 13, and the other end connected to the switching element 34. The freewheeling diode 345 has an anode connected between the switching element 34 and the switching element 335, and a cathode connected between the center tap 14 and the switching element 33.

In this structure, when the control circuit 60 stops energy addition (power supply) while maintaining a spark discharge, the control circuit 60 opens the switching element 34 with the switching element 335 closed to allow a current to keep flowing through the second winding 11*b* via the freewheeling diode 345. When the control circuit 60 stops energy addition (power supply) while maintaining a spark discharge, the control circuit 60 may also open the switching element 32 as in the embodiment described above.

Figure 10:
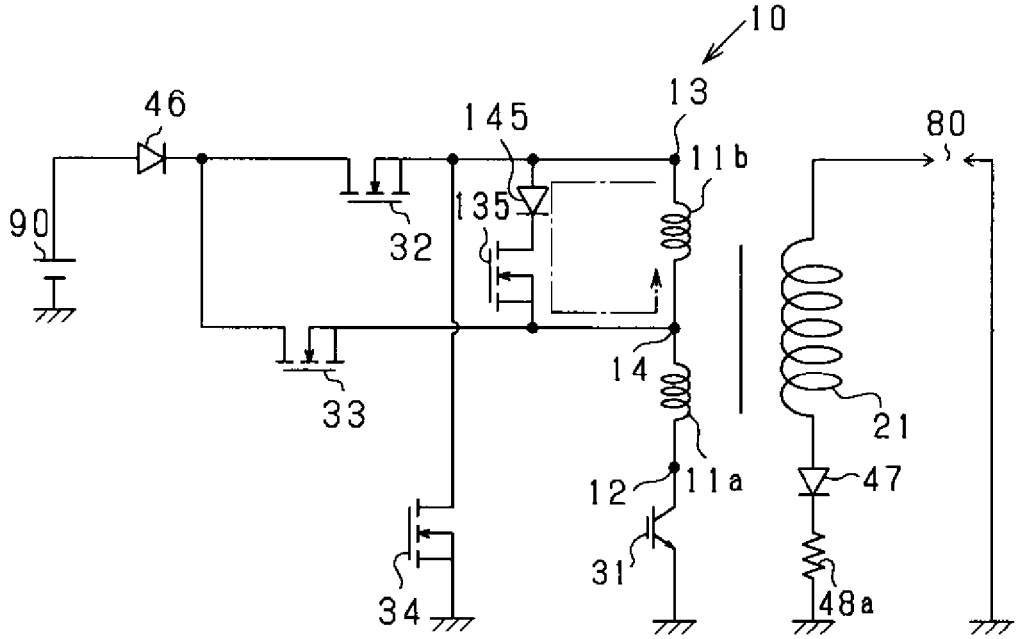
FIG. 10 is a circuit diagram illustrating the electrical structure of an ignition device according to still another modification.

In yet another example, as illustrated in FIG. 10, the freewheeling mechanism may include a freewheeling diode 145 provided in parallel with the second winding 11*b*, and a switching element 135 serving as a freewheeling control switch provided in parallel with the second winding 11*b* and connected in series to the freewheeling diode 145. More specifically, the freewheeling diode 145 has an anode connected between the switching element 32 and the second terminal 13, and a cathode connected between the switching element 33 and the center tap 14. One end of the switching element 135 is connected to the cathode of the freewheeling diode 145, while the other end thereof is connected between the switching element 33 and the center tap 14.

In this structure, when the control circuit 60 maintains the spark discharge, the control circuit 60 closes the switching elements 33 and 34 and opens the switching element 135 to allow energy addition (power supply) from the battery 90 to the second winding 11*b*. In contrast, when the control circuit 60 maintains a spark discharge, the control circuit 60 opens the switching element 34 and closes the switching element 135 to stop the energy addition from the battery 90 to the second winding 11*b*. Stopping the energy addition in this manner allows a current to keep flowing through the second winding 11*b* via the freewheeling diode 145 and the switching element 135.

In the embodiment described above, the center tap 14 is provided in the primary coil 11 to form the first winding 11*a* and the second winding 11*b*. However, separate windings may form the first winding 11*a* and the second winding 11*b*.

In the embodiment described above, the upper limit and the lower limit of the target secondary current may be constant values and preset in the feedback circuit 67. This eliminates the need for the setting circuit 66.

In the embodiment described above, the upper limit and the lower limit of a target secondary current are set based on the time difference between the rising edges of the primary ignition signal IGT and the energy addition signal IGW. However, the setting method may be changed as appropriate. For example, the setting circuit 66 may receive a setting instruction signal from the ECU 70 and set the upper limit and the lower limit of a target secondary current in accordance with the instruction signal.

In the embodiment described above, the control circuit 60 may control the opening and closing of the switching element 33 at predetermined times without feedback control. For example, in energy addition ignition, the control circuit 60 may open or close the switching element 33 at predetermined switching time intervals. This method eliminates the need for sensing a secondary current Ib, thus allowing the current sensing circuit 48 to be removed. In addition, the feedback circuit 67 may also be removed. The predetermined switching time intervals may be set by the setting circuit 66 or the ECU 70.

In the embodiment described above, the backflow prevention diode 46 may be removed.

In the embodiment described above, some or all of the components of the ignition device 10 may be outside the case 50 for the ignition coil.

In the embodiment described above, the battery 90 is used for two or more purposes. However, different power sources may also be included. More specifically, power sources with different voltages may be used for the primary ignition and the energy addition. This allows adjustment of the turns ratio of the secondary coil 21 to the second winding 11*b*.

In the embodiment described above, the battery 90 is an on-vehicle power source. However, the battery 90 may be incorporated in the ignition device 10.

In the embodiment described above, a booster circuit may also be provided. In energy addition ignition, the control circuit 60 may apply a voltage raised by the booster circuit to the second winding 11*b*. This allows adjustment of the turns ratio of the secondary coil 21 to the second winding 11*b*.

In the embodiment described above, the wire diameter of the second winding 11*b* may be greater than the wire diameter of the first winding 11*a*. When the spark discharge is maintained, this allows a current flowing through the second winding 11*b* to become larger to increase the secondary current Ib. An increase in the wire diameter of only the second winding 11*b* can prevent an increase in the size of the entire primary coil 11.

Although the ignition device 10 in the embodiment described above is used for a multicylinder engine, the ignition device 10 may be used for a single cylinder engine. The ignition device 10 may also be used for an internal combustion engine that uses a fuel other than gasoline.

In the embodiment described above, the delay time T1 from the high-to-low transition of the primary ignition signal IGT to the signal output by the delay circuit 65 to the driving circuit 64 may be changed as appropriate.

In the embodiment described above, the control circuit 60 in the primary ignition operation opens or closes the switching element 31 and the switching element 32 at the same time. However, opening or closing at different times can achieve the same effect.

In the embodiment described above, the switching element 34 is opened when the secondary current seems at the lower limit. Instead, the output from the feedback circuit 67 may be delivered to the driving circuit 64 to control the opening in response to the secondary current reaching the lower limit, or with higher accuracy. In some cases, a long period of time may be set for the freewheeling secondary current Ib to completely decay.

Although the present disclosure has been described based on the embodiments, it is to be understood that the disclosure is not limited to the embodiments and configurations. This disclosure encompasses various modifications and alterations falling within the range of equivalence. Additionally, various combinations and forms as well as other combinations and forms with one, more than one, or less than one element added thereto also fall within the scope and spirit of the present disclosure.

According to a first aspect, an ignition device (10) for generating a spark discharge at a spark plug (80) includes: a primary coil (11) including a first winding (11*a*), a second winding (11*b*) connected in series to the first winding, a first terminal (12) at the opposite end of the first winding from a connection point (14) between the first winding and the second winding, and a second terminal (13) at the opposite end of the second winding from the connection point; a secondary coil (21) connected to the spark plug and magnetically coupled to the primary coil; a first switch (31) that connects with the first terminal of the primary coil and opens or closes the electrical path between the first terminal and the ground; a second switch (32) that connects with the second terminal of the primary coil and opens or closes the electrical path between the power source (90) and the second terminal; a third switch (33) that connects with the connection point of the second winding and opens or closes the electrical path between the power source and the connection point; a fourth switch (34) that connects with the second terminal of the second winding and opens or closes the electrical path between the second terminal and the ground; and a switch control unit (60) that controls the opening and closing of the first switch, the second switch, the third switch, and the fourth switch to open or close each electrical path.

In this aspect, the first switch and the second switch are closed for a current to flow from the second terminal of the primary coil (the first winding and the second winding) to the first terminal, and then the first switch and the second switch are opened to stop the energization of the primary coil. This allows the generation of a secondary voltage in the secondary coil and a spark discharge at the spark plug. After the generation of the spark discharge, the third switch and the fourth switch can be closed to energize the second winding. During the energization, a current flows from the connection point to the second terminal. In this manner, an additional current is allowed to flow in the same direction as the secondary current flowing through the secondary coil, thereby maintaining the spark discharge.

To start a spark discharge, a current is caused to flow through the primary coil (the first winding and the second winding). To maintain the spark discharge, a current is caused to flow through the second winding. Thus, even for a high turns ratio of the secondary coil to the second winding, the number of turns of the first winding can be adjusted to prevent an increase in the turns ratio of the secondary coil to the primary coil. This coil structure allows a high secondary current to flow through the secondary coil at the start of a spark discharge, and a high secondary voltage to be generated in the secondary coil for maintaining the spark discharge. In other words, the spark discharge can be maintained in an appropriate manner without deterioration in the ignitability.

According to a second aspect, when the switch control unit starts the spark discharge, the switch control unit closes the first switch and the second switch with the third switch and the fourth switch open, to cause a current to flow from the second terminal of the primary coil to the first terminal. After that, the switch control unit opens the first switch and the second switch to stop the energization of the primary coil. When the switch control unit maintains the spark discharge after the spark discharge is started, the switch control unit closes the third switch and the fourth switch to cause a current to flow from the connection point to the second terminal.

In this aspect, the first switch and the second switch are closed for a current to flow from the second terminal of the primary coil (the first winding and the second winding) to the first terminal, and then the first switch and the second switch are opened to stop the energization of the primary coil from the power source. This allows the generation of a secondary voltage in the secondary coil and a spark discharge at the spark plug. When the spark discharge is started, both the third switch and the fourth switch are opened to prevent a decrease in the current from the second terminal to the first terminal.

After the generation of the spark discharge, the third switch and the fourth switch are closed to energize the second winding. At the same time, a current flows from the connection point to the second terminal. In this manner, an additional current is allowed to flow in the same direction as the secondary current flowing through the secondary coil, thereby maintaining the spark discharge. When the spark discharge is maintained, both the first switch and the second switch are opened to prevent a reduction in the current from the connection point to the second terminal.

According to a third aspect, when the switch control unit maintains the spark discharge, the switch control unit alternates closing the third switch and the fourth switch to cause a current to flow from the connection point to the second terminal and opening the third switch or the fourth switch to stop the power supply from the power source to the second winding. The ignition device further includes a freewheeling mechanism (45, 145, 135, 245, 335, 345) that keeps a current flowing through the second winding when the power supply is stopped.

In this aspect, when the power supply is stopped while the spark discharge is being maintained, the freewheeling mechanism keeps a current flowing through the second winding. Thus, while the spark discharge is being maintained, a sudden decrease is prevented in the current flowing in the second winding to prevent a sudden decrease in the secondary current flowing through the secondary coil.

According to a fourth aspect, the freewheeling mechanism includes a freewheeling diode (45) having an anode connected to the ground and a cathode connected between the connection point and the third switch.

In this aspect, when the power supply is stopped while the spark discharge is being maintained, the third switch is opened with the fourth switch closed to allow a current to keep flowing through the second winding via the freewheeling diode. Thus, the freewheeling mechanism can be provided in a simple structure and prevent a sudden decrease in the secondary current to reduce the possibility that the spark discharge will stop.

According to a fifth aspect, the freewheeling mechanism includes a freewheeling diode (145) provided in parallel with the second winding and having an anode connected between the second switch and the second terminal and a cathode connected between the third switch and the connection point, and a freewheeling control switch (135) provided in parallel with the second winding and connected in series to the freewheeling diode.

In this aspect, when the power source supplies the second winding with power while the spark discharge is being maintained, the third switch and the fourth switch are closed, and the freewheeling control switch is opened. In contrast, when the power source stops the power supply to the second winding, the fourth switch is opened and the freewheeling control switch is closed. In this manner, when the power supply is stopped, the freewheeling diode and the freewheeling control switch allow a current to keep flowing through the second winding, thereby preventing a sudden decrease in the secondary current to reduce the possibility that the spark discharge will stop.

According to a sixth aspect, the freewheeling mechanism includes a freewheeling diode (245) provided in parallel with the second switch and having an anode connected between the second terminal and the second switch and a cathode connected between the power source and the second switch.

In this aspect, when the power supply is stopped while the spark discharge is being maintained, the fourth switch is opened with the third switch closed to allow a current to keep flowing through the second winding via the freewheeling diode and the third switch. This prevents a sudden decrease in the secondary current to reduce the possibility that the spark discharge will stop. If the second switch has its parasitic diode, the parasitic diode may be used. In this way, such a simple structure provides a freewheeling mechanism.

According to a seventh aspect, the freewheeling mechanism includes a fifth switch (335) provided between the second terminal and the fourth switch and connected in series to the fourth switch, and a freewheeling diode (345) having an anode connected between the fourth switch and the fifth switch and a cathode connected between the connection point and the third switch.

In this aspect, when the power supply is stopped while the spark discharge is being maintained, the fourth switch is opened with the fifth switch closed to allow a current to keep flowing through the second winding via the freewheeling diode. This prevents a sudden decrease in the secondary current.

According to an eighth aspect, the ignition device further includes a secondary current sensing unit (48) that senses a secondary current flowing through the secondary coil. When the switch control unit maintains the spark discharge, the switch control unit opens or closes the third switch in accordance with the secondary current sensed by the secondary current sensing unit.

In this aspect, the secondary current is sensed, and the third switch can be opened or closed in accordance with the sensed secondary current to control the power supply from the power source to the second winding and the stop of the supply, in a manner to keep the secondary current within appropriate values.

According to a ninth aspect, the ignition device includes a backflow prevention diode (46) having an anode connected to the power source. The second switch is connected to the cathode of the backflow prevention diode and allows passage of a current coming from the power source via the backflow prevention diode. The third switch is connected to the cathode of the backflow prevention diode and allows passage of a current coming from the power source via the backflow prevention diode.

A typical switch has an antiparallel body diode. Thus, if the power source is reverse connected, a large current may flow through the circuit via a body diode. In this aspect, however, even if the power source is reverse connected, the backflow prevention diode can protect the circuit. In particular, even if the second winding has low impedance, a large current can be prevented from flowing through the circuit.

According to a tenth aspect, the secondary coil and the second winding have a turns ratio determined by dividing the number of turns of the secondary coil by the number of turns of the second winding, and the turns ratio is greater than the voltage ratio determined by dividing a discharge maintaining voltage sufficient to maintain the spark discharge by a voltage applied by the power source.

When the spark discharge is maintained, this coil structure allows energy addition without a booster circuit.

According to an 11th aspect, the second winding has a wire diameter greater than the wire diameter of the first winding.

When the spark discharge is maintained, this allows a current flowing through the second winding to become larger to increase the secondary current. An increase in the wire diameter of only the second winding can prevent an increase in the size of the entire primary coil.

According to a 12th aspect, the power source for applying a voltage to the primary coil when the spark discharge is started is an on-vehicle power source and also serves as a power source for applying a voltage to the second winding when the spark discharge is maintained.

The ignition device may not include a power source, and accordingly the ignition device may be reduced in size. The use of the on-vehicle power source eliminates the need for an extra power source, allowing a reduction in size. Also, the use of the on-vehicle power source for two or more purposes eliminates the need for different power sources, thus allowing a reduction in size.

According to a 13th aspect, the primary coil, the secondary coil, the first switch, the second switch, the third switch, the fourth switch, and the switch control unit are contained in an ignition coil case (50).

Containing the components in the ignition coil case facilitates the installation in a vehicle and allows a reduction in wiring.

What is claimed is:

1. An ignition device for generating a spark discharge at a spark plug, the ignition device comprising:

a primary coil including a first winding, a second winding connected in series to the first winding, a first terminal at an opposite end of the first winding from a connection point between the first winding and the second winding, and a second terminal at an opposite end of the second winding from the connection point;

a secondary coil connected to the spark plug and magnetically coupled to the primary coil;

a first switch connecting with the first terminal of the primary coil and configured to open or close an electrical path between the first terminal and ground;

a second switch connecting with the second terminal of the primary coil and configured to open or close an electrical path between a power source and the second terminal;

a third switch connecting with the connection point of the second winding and configured to open or close an electrical path between the power source and the connection point;

a fourth switch connecting with the second terminal of the second winding and configured to open or close an electrical path between the second terminal and the ground; and a switch control unit configured to control opening and closing of the first switch, the second switch, the third switch, and the fourth switch to open or close each of the electrical paths.

2. The ignition device according to claim 1, wherein when the switch control unit starts the spark discharge, the switch control unit closes the first switch and the second switch with the third switch and the fourth switch open, to cause a current to flow from the second terminal of the primary coil to the first terminal, thereafter opening the first switch and the second switch to stop energization of the primary coil, and when the switch control unit maintains the spark discharge after the spark discharge is started, the switch control unit closes the third switch and the fourth switch to cause a current to flow from the connection point to the second terminal.

3. The ignition device according to claim 1, wherein when the switch control unit maintains the spark discharge, the switch control unit alternates closing the third switch and the fourth switch to cause a current to flow from the connection point to the second terminal and opening the third switch or the fourth switch to stop power supply from the power source to the second winding, and the ignition device further comprises a freewheeling mechanism configured to keep a current flowing through the second winding when the power supply is stopped.

4. The ignition device according to claim 3, wherein the freewheeling mechanism includes a freewheeling diode having an anode connected to the ground and a cathode connected between the connection point and the third switch.

5. The ignition device according to claim 3, wherein the freewheeling mechanism includes a freewheeling diode provided in parallel with the second winding and having an anode connected between the second switch and the second terminal and a cathode connected between the third switch and the connection point, and a freewheeling control switch provided in parallel with the second winding and connected in series to the freewheeling diode.

6. The ignition device according to claim 3, wherein the freewheeling mechanism includes a freewheeling diode provided in parallel with the second switch and having an anode connected between the second terminal and the second switch and a cathode connected between the power source and the second switch.

7. The ignition device according to claim 3, wherein the freewheeling mechanism includes a fifth switch provided between the second terminal and the fourth switch and connected in series to the fourth switch, and a freewheeling diode having an anode connected between the fourth switch and the fifth switch and a cathode connected between the connection point and the third switch.

8. The ignition device according to claim 1, further comprising a secondary current sensing unit configured to sense a secondary current flowing through the secondary coil, wherein when the switch control unit maintains the spark discharge, the switch control unit opens or closes the third switch in accordance with the secondary current sensed by the secondary current sensing unit.

9. The ignition device according to claim 1, further comprising a backflow prevention diode having an anode connected to the power source, wherein the second switch is connected to a cathode of the backflow prevention diode and allows passage of a current coming from the power source via the backflow prevention diode, and the third switch is connected to the cathode of the backflow prevention diode and allows passage of a current coming from the power source via the backflow prevention diode.

10. The ignition device according to claim 1, wherein the secondary coil and the second winding have a turns ratio determined by dividing the number of turns of the secondary coil by the number of turns of the second winding, and the turns ratio is greater than a voltage ratio determined by dividing a discharge maintaining voltage sufficient to maintain the spark discharge by a voltage applied by the power source.

11. The ignition device according to claim 1, wherein the second winding has a wire diameter greater than a wire diameter of the first winding.

12. The ignition device according to claim 1, wherein the power source for applying a voltage to the primary coil when the spark discharge is started is an on-vehicle power source and also serves as a power source for applying a voltage to the second winding when the spark discharge is maintained.

13. The ignition device according to claim 1, wherein the primary coil, the secondary coil, the first switch, the second switch, the third switch, the fourth switch, and the switch control unit are contained in an ignition coil case.

* * * * *